US008047805B2

(12) United States Patent
Bourell, Jr. et al.

(10) Patent No.: US 8,047,805 B2
(45) Date of Patent: Nov. 1, 2011

(54) SOLID STATE SUMP PUMP CONTROL

(76) Inventors: Alfred M. Bourell, Jr., Memphis, TN (US); Ricky W. Cox, Bartlett, TN (US); David K. Morton, Oakland, TN (US); Roderick C. Truitt, Collierville, TN (US); Curtis T. Washington, Collierville, TN (US)

( * ) Notice: Subject to any disclaimer, the term of this patent is extended or adjusted under 35 U.S.C. 154(b) by 1076 days.

(21) Appl. No.: 11/848,707

(22) Filed: Aug. 31, 2007

(65) Prior Publication Data

US 2009/0060751 A1 Mar. 5, 2009

(51) Int. Cl.
*F04B 49/00* (2006.01)

(52) U.S. Cl. ..... 417/36; 417/44.1; 73/290 R

(58) Field of Classification Search ..... 417/36, 417/44.1; 73/290 R

See application file for complete search history.

(56) References Cited

U.S. PATENT DOCUMENTS

| | | | | | |
|---|---|---|---|---|---|
| 2,424,657 | A | * | 7/1947 | Goodman | 200/183 |
| 4,014,475 | A | | 3/1977 | Grace et al. | |
| 4,061,442 | A | * | 12/1977 | Clark et al. | 417/36 |
| 4,107,008 | A | * | 8/1978 | Horvath | 205/339 |
| 4,215,975 | A | | 8/1980 | Niedermeyer | |
| 4,583,915 | A | * | 4/1986 | Montgomery et al. | 417/18 |
| 4,898,513 | A | | 2/1990 | Hon | |
| 4,901,056 | A | * | 2/1990 | Bellavia et al. | 340/514 |
| 4,919,343 | A | | 4/1990 | Van Luik, Jr. et al. | |
| 5,158,475 | A | * | 10/1992 | Tyler | 439/439 |
| 5,324,170 | A | | 6/1994 | Anastos et al. | |
| 5,439,180 | A | | 8/1995 | Baughman et al. | |
| 5,577,890 | A | * | 11/1996 | Nielsen et al. | 417/44.2 |
| 5,923,102 | A | | 7/1999 | Koenig et al. | |
| 5,968,386 | A | * | 10/1999 | Goenka et al. | 219/209 |
| 6,712,553 | B1 | | 3/2004 | Niedermeyer | |
| 6,874,983 | B2 | * | 4/2005 | Moerke et al. | 411/46 |
| 6,997,642 | B2 | | 2/2006 | Bishop, Jr. | |
| 7,168,691 | B2 | | 1/2007 | MacLaren | |
| 7,174,844 | B2 | | 2/2007 | Hebert et al. | |
| 7,373,817 | B2 | * | 5/2008 | Burdi et al. | 73/290 R |
| 7,492,272 | B1 | * | 2/2009 | MacDonald | 340/618 |

OTHER PUBLICATIONS

Website (6 pages printed and available at least as of Sep. 27, 2007) http://www.nextag.com/flotec-sump-pump/search-html.

Website (3 pages printed and available at least as of Sep. 27, 2007) http://www.secwaterinc.com/oil_smart_simplex_total_pump_protection.htm.

* cited by examiner

*Primary Examiner* — Charles Freay
*Assistant Examiner* — Patrick Hamo
(74) *Attorney, Agent, or Firm* — Peter L. Brewer; Baker, Donelson, Bearman, Caldwell & Berkowitz, PC

(57) ABSTRACT

The present invention provides a sump pump control system. The system includes a mounting fixture fabricated from a corrosion resistant material, and an electrical control comprising solid state electrical components supported by the mounting fixture. The sump pump control system also includes a diving bell cover. The diving bell cover has an open bottom, and is dimensioned to cover the electrical components. The diving bell cover is releasably secured to a support surface of the mounting fixture. The electrical control controls the operation of a sump pump. Should water rise to a level of the electrical components due to failure of the sump pump or due to quickly rising water, the diving bell cover will prevent water from contacting the electrical components. A method of removing water from a subterranean vault is also provided herein.

12 Claims, 3 Drawing Sheets

SOLID STATE SUMP PUMP CONTROL

FIELD OF THE INVENTION

The invention relates to the field of electrical circuitry. More specifically, the invention relates to the field of protecting electrical circuitry from the deleterious effects of moisture.

BACKGROUND OF THE INVENTION

Utility companies in urban areas frequently use underground substations. Each substation resides in a "vault" and includes one or more transformers. Some vaults are small and consist of only a single transformer, while other vaults are large and consist of several transformers. The substations also typically include wires, power panels, lights, receptacles and other components normally found in an electrical utility system.

Within urban areas, substations are connected to form a subterranean electrical power grid. For example, the City of Memphis, operating through Memphis Light, Gas & Water (or "MLG&W") uses a 115 kV underground "pipeline" that runs through parts of the city, particularly downtown, where surface utilities are impractical and unsightly. The utility's 115 kV pipeline system consists of 40 manholes for accessing the individual substations. The manholes generally reside at sidewalk or street level.

Because the vaults are underground, they are subject to water invasion when it rains. The presence of water in the vault creates a number of problems. For example, a wet floor can create a safety hazard to maintenance personnel. Also, the presence of water creates an environment of high humidity. This, in turn, contributes to rusting and pitting of the metal components in the substations. More seriously, the presence of water creates a potential for electrical shock and electrical outage of the system.

In order to reduce the presence of water, each vault is covered by a manhole cover or grate. In addition, each vault is commonly equipped with a sump pump. The pumps are controlled by a dielectric sump pump control mechanism. Each mechanism includes a first probe at ground level, and a second probe just above ground level. The control mechanism takes advantage of the conductivity of the water, and uses the water to complete the circuit formed by the probes and the pump. When the water contacts each of the probes, the pump is electrically activated. Then when the sump pump is activated, water is pumped out of the vault. Typically, the water is simply pumped into the street.

A problem arises when water invades the vault at a rate faster than the pump can remove it. When the vault floods, the controls that operate the sump pump are exposed to water. Conventional sump pump controls are normally damaged beyond repair once the vault is flooded with water. Of course, the presence of a high level of water also may damage the power panels, lights, receptacles, wiring, transformers, and protectors that make up the substation.

Another problem arises when oil leaks into a substation. Oil may be present when a transformer or other item of equipment begins to leak or lose containment of an insulating and/or heat-dissipating fluid. A sump pump that begins to pump oil will simply pump the oil into the street, creating an environmentally undesirable circumstance.

In light of the above problems and others, a need exists for an improved sump pump control. A need further exists for a sump pump control that is able to operate when a vault for a substation becomes flooded without being exposed to liquids.

Still further, a need exists for a sump pump control that shuts off before oil is substantially pumped out of the vault.

SUMMARY OF THE INVENTION

The present invention provides a sump pump control system. In one aspect, the sump pump control system includes a mounting fixture. The mounting fixture has a support surface and a mounting plate. Preferably, the support surface and the mounting plate are fabricated from a corrosion resistant material such as stainless steel.

The sump pump control system also includes an electrical control. The control has various solid state electrical components that are connected to a chassis. For example, the electrical components may include a solid state circuit board and a solid state power relay. The electrical components may also include a hermetically sealed control relay, a transformer, and a terminal strip.

The chassis is supported on the support surface of the mounting fixture. Preferably, the chassis is also fabricated from a corrosion resistant material.

The sump pump control system also includes a diving bell cover. The diving bell cover has an open bottom and is configured to encompass the electrical components. The diving bell cover is releasably secured to the support surface of the mounting fixture.

The electrical control controls the operation of a sump pump. The electrical components are mounted onto the chassis at a position above the bottom of the diving bell cover such that water will not contact the electrical components in the event that water surrounds the diving bell cover. Preferably, the electrical components are sprayed with a clear waterproof coating.

In one aspect, the sump pump control system includes the sump pump. The sump pump is part of a sump pump assembly that comprises a common probe, an "on" probe and an "off" probe.

Methods for removing water from a subterranean vault are also provided herein. Preferably, the subterranean vault is an electrical substation. In one aspect, the method includes securing a mounting fixture to a structure within the vault above a ground level. The mounting fixture has a support surface and a mounting plate. Preferably, the support surface and the mounting plate are fabricated from a corrosion resistant material such as stainless steel.

The method also includes providing a sump pump control system. The sump pump control system may be the system as described above, in any of its embodiments. The method would also then include providing power to the sump pump assembly.

In one aspect, the sump pump control system further comprises at least one latch for releasably securing the diving bell cover to the support surface of the mounting fixture. The at least one latch may include at least two latches, and is fabricated from an elastomeric material. The method then further comprises securing the diving bell cover to the support surface of the mounting fixture.

In one aspect, the sump pump control system further comprises an externally operable test switch. The externally operable test switch may be comprises a magnetic reed switch, and the sump pump control further comprises a permanent magnet that may be passed over the diving bell cover in order to selectively momentarily turn on the sump pump. In this instance, the method may then further comprise passing the magnet over the diving bell cover to temporarily activate the sump pump.

The method preferably includes attaching a desiccant cartridge for absorbing moisture to the chassis or the mounting fixture.

In one embodiment, the subterranean vault contains both water and oil. In this instance, the method further comprises pumping water from the subterranean vault, but then discontinuing pumping water before significant amounts of oil are encountered by the sump pump.

BRIEF DESCRIPTION OF THE DRAWINGS

Objects, advantages and novel features of the present inventions will become apparent from the following detailed description when considered in conjunction with the accompanying drawings. It is to be noted, however, that the drawings illustrate only selected embodiments of the inventions and are therefore not to be considered limiting of scope, for the inventions may admit to other equally effective embodiments and applications.

DESCRIPTION OF CERTAIN EMBODIMENTS

Definitions

The term "vault" refers to any enclosed area that is susceptible to water encroachment or flooding, and which relies upon a sump pump to remove water from the enclosed area. One non-limiting example of a vault is a substation vault of a utility company.

The term "sump pump" refers to any pumping mechanism for removing water or fluids containing water from a vault. The pump need not rest in a true "sump," but may rest at floor level within a vault.

The term "diving bell cover" includes any container of any shape that is inverted to provide an open bottom.

Description of Selected Specific Embodiments

Figure 1:
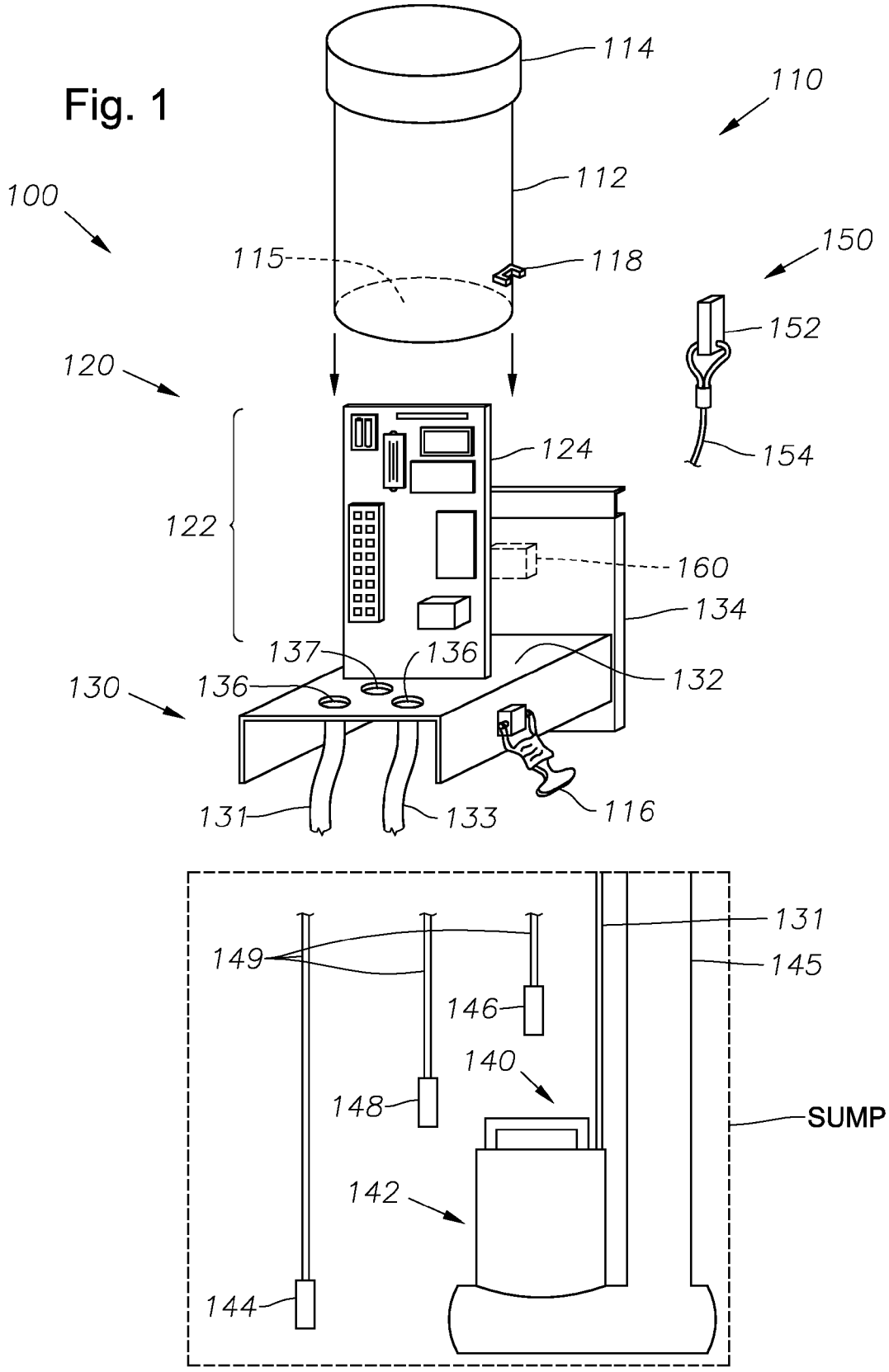
FIG. 1 is a perspective view of the sump pump control system of the present invention, in one embodiment.

FIG. 1 is a perspective view of the sump pump control system 100 of the present invention, in one embodiment. The sump pump control system 100 is designed to control the operation of a sump pump within a vault.

The sump pump control system 100 first comprises a cover 110. The cover 110 is dimensioned and configured to cover the electronic components 122 of the sump pump control system 100. The electronics are discussed below in connection with the pump controls 120. In one embodiment, the cover 110 has an outer diameter that is 4 to 10 inches. More preferably, the outer diameter is 6 inches. The wall thickness is about ¼ inches. In one embodiment, the length (or height) of the cover 110 is about 10 to 18 inches. More preferably, the height is about 12 inches.

The cover 110 is fabricated from a water-impenetrable material. One suitable material is polyvinyl chloride, or PVC. In the arrangement of FIG. 1, the cover 110 comprises a cylindrical body 112 and a cap 114. The body 112 has an open lower end or bottom 115, while the top is sealed by the cap 114.

The body 112 and the cap 114 may be integrally formed. However, it is preferred that the body 112 be fabricated or cut from a longer section of cylindrical PVC material, and the cap 114 being affixed to the top end of the body 112. An adhesive material such as Rectorseal PVC Cement may be applied to an outer diameter of the body 112 and/or an inner diameter of the cap 114 to create a water-tight seal between the body 112 and the cap 114.

The cylindrical cover 110 protects the control components 120 from exposure to water or other liquids in the case of flooding. More specifically, the cover 110 prevents the sump pump controls 120 from being exposed to water when the water level rises faster than the pump can operate.

To meet this function, the cover 110 operates as a removable "diving bell." When positioned over the electronics, the cover 110 holds air that surrounds the pump controls 120. Thus, in the event that water rises to a level above the pump controls 120, the air pressure under the cap 114 prevents water from invading the bottom 115 of the cover 110 and contacting the controls 120.

It is desirable to secure the cover 110 in place over the controls 120. In the arrangement of FIG. 1, a pair of latches is provided (one latch 116 being visible in FIG. 1). Preferably, the latch 116 is fabricated from a natural or synthetic rubber material that will not corrode or rust in the presence of moisture. Advantageously, the natural or synthetic rubber material is pliable and elastic so that precise fitting of the latches 116 relative to the cover 110 is not required. The latches 116 attach to brackets (one bracket 118 being visible in FIG. 1) disposed along an outer surface of the cover 110.

The sump pump control system 100 next comprises the electronic control 120. The control 120 is shown generally in FIG. 1, and represents an assimilation of electronic components 122. The individual electronic components 122 of the controls 120 are identified and described specifically below in connection with FIG. 2.

The electronic components 122 are mounted onto a chassis 124. The chassis 124 and the connected components 122 are secured to a mounting fixture 130. The mounting fixture 130, in turn, is secured to a wall or other vertical surface. More specifically, the mounting fixture 130 is secured a distance above the floor of a vault to avoid at least some instances of flooding. In one aspect, the mounting fixture 130 is secured about three to four feet above the floor.

The mounting fixture 130 includes a substantially horizontal support surface 132. The support surface 132 receives and supports the sump pump control 120, to wit, the chassis 124 and connected electrical components 122. The support surface 132 also receives and supports the cover 110 when it is placed around the control 120. The bottom or open end 115 rests on the support surface 132.

In order to support the sump pump control 120 and the surrounding cover 110, it is preferred that the horizontal support surface 132 be about 12 to 20 inches in width, and about 14 to 24 inches in length. Preferably the horizontal support surface 132 is 7 inches in width and 8¼ inches in length.

It is noted that the support surface 132 supports the latches 116 that are releasably connected to the cover 110. In addition, through-openings 136, 137 are provided through the support surface 132. The through-openings 136 receive and secure electrical wiring bundles 131, 133, 149. In one aspect, wiring bundle 131 provides control wiring as between the control components 122 and a sump pump assembly 140. Wiring bundle 133 receives power wiring from a power supply, and also delivers power wiring to a sump pump (pump shown at 142 in FIG. 1.).

It is understood that the wiring bundles 131, 133, 149 comprise numerous individual wires that extend through the through-openings 136, 137 and connect to the electrical components 122. Power and pump motor conductors 131, 133 may use, for example, copper 16/3 SOOW cord. Probe wiring bundle 149 may use, for example, Ametek B&W wire # 6013SW. When the cover 110 is latched onto the support surface 132, the cover 110 encompasses the wires extending out of the wiring bundles 131, 133, 149.

The mounting fixture 130 also includes a mounting plate 134. The mounting plate 134 is connected to a wall or other vertical surface (not shown) within the vault. The mounting plate 134 enables the control 120 to be affixed to the support surface 132 in the shop or factory, and then installed in a vault together as a unit.

It is preferred that the various plates 124, 132, 134 be fabricated from a material that is resistant to rusting or pitting in a humid environment. A suitable material is stainless steel. In one instance, the plates 124, 132, 134 are preferably stamped or die cut from larger sheets of 14 gauge stainless steel. Other corrosion resistant steels may be used, preferably comprising an iron-carbon alloy having a minimum of 10% by weight chromium.

Figure 2:
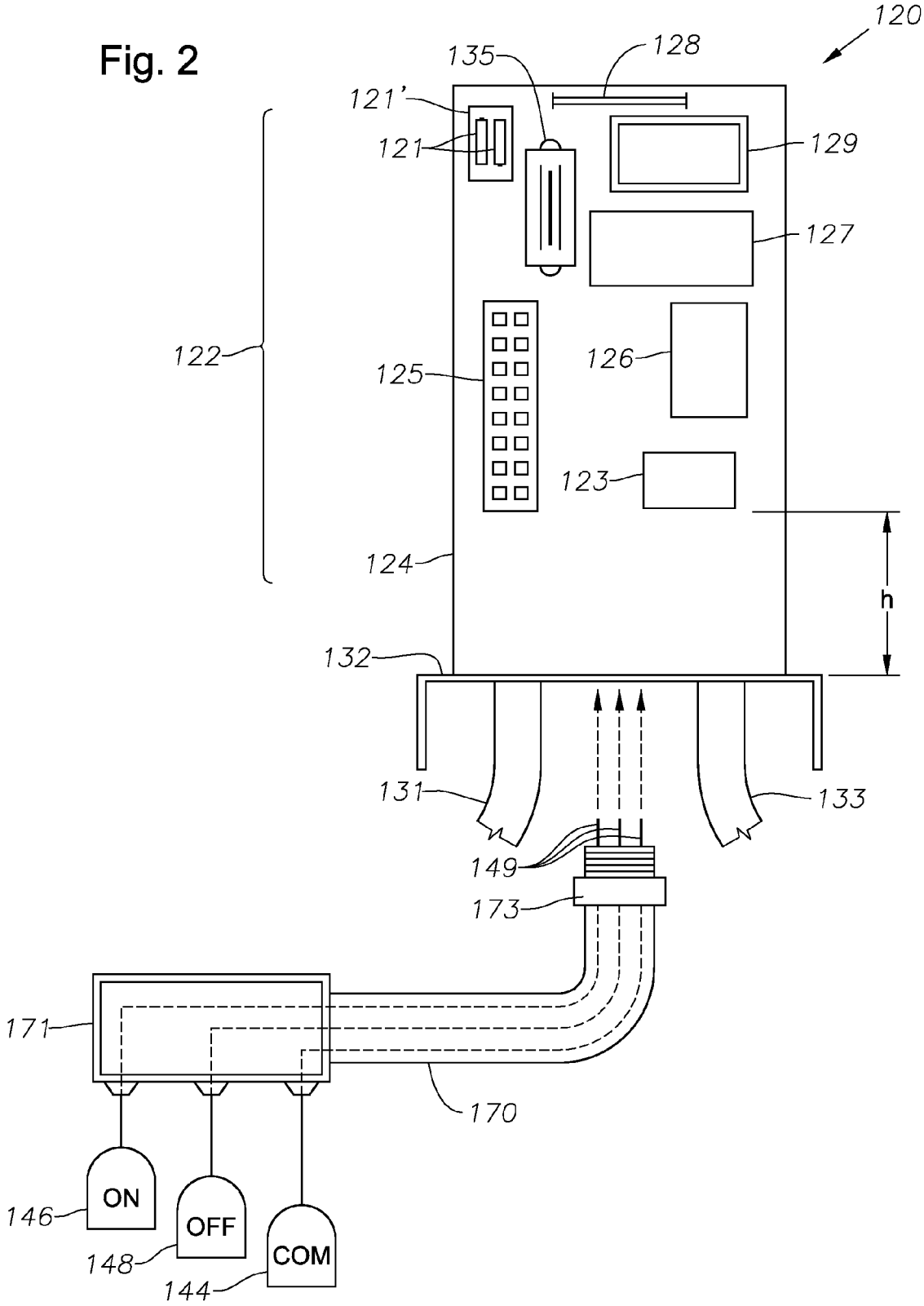
FIG. 2 is a plan view of the pump control of FIG. 1, in a modified schematic view.

Referring now to FIG. 2, FIG. 2 shows a somewhat schematic front view of a sump pump control 120, in one embodiment. Various electrical components 122 are seen mounted onto the plate 124.

Among the components 122, batteries 121 may be provided. The batteries 121 are stored in a battery holder 121'. The batteries 121 are preferably 1.5 volt batteries, although other size batteries may be used.

The batteries 121 provide power to a digital counter 129. The digital counter 129 counts each time the pump 142 cycles on/off. This, in turn, provides an indication of how often a vault or other environment is exposed to rising water levels. In some vaults, a pump 142 may cycle several times a day. Therefore, an 8-digit counter is preferred. In one embodiment, a Falcon TruMeter counter having part no. HED261-R is used. This counter may be purchased through MSC Industrial Supply Company, which serves as a distributor.

A terminal strip 125 is also included in the electrical components 122. The terminal strip 125 provides a point of connection for various wires, or leads. Such leads include power leads, pump leads, and probe leads.

The electrical components also include a pair of relays 123, 126. The first relay 123 serves as a control relay for switching control signals to one or more of the electronic components 122. A suitable example of such a control relay 123 is part no. 850-2090 from Allied Electronics. The control relay 123 plugs into an 8-pin socket 119 that is mounted onto the chassis 124. The 8-pin socket 119 has 8 terminal screws which receive control wiring to connect various electronic components 122 to the relay 123.

The second relay 126 serves as a power relay for switching power to the pump 142 to turn it on/off. This is typically a 50-Amp solid state relay. The power relay 126 may be, for example, part no. 886-2451 from Allied Electronics. It is noted that most of the components 122 typically have an operating characteristic (e.g., capacity and/or load) of 15 Amps or less. However, because the pump 142 is powered via the relay 126, it is desirable for the power relay 126 to have a higher operating capacity than other components 122. In this respect, if a rock or some other object hangs up in the pump 142, the 50-Amp relay 126 will have the capacity to withstand the excessive load created by such an obstruction.

The electrical components 122 also include a circuit board 127. The circuit board is available from Austin Brown, acting as a distributor of B&W controls. The circuit board 127 is configured to receive and transmit control signals between one or more of the electronic components 122. For example, the circuit board 127 can receive control signals via fluid probes 144, 146, 148 and transmit control signals to the relays 123, 126 to operate the pump 142 and other components 122. Wiring bundles 149 provide control wiring between the control 122 and the probes 144, 146, 148.

In order to further protect the sump pump control 120 from the deleterious effects of moisture, it is desirable that the various electrical components 122 be solid state components. Thus, rather than using exposed electrical contacts or moving parts as are known in the utility industry, a solid state circuit is typically utilized. "Solid state" refers to electronic components where electrons flow through unheated, solid semiconductor materials such as Germanium (Ge) or Silicon (Si). Solid-state devices are typically more reliable than their thermionic counterparts, e.g., vacuum tubes or relays, due to their superior resistance to vibration, moisture, and mechanical wear.

It is noted that some of the electronic components 122, such as the control relay 123, are not solid state devices. Probe circuitry generally requires the use of physically open contacts with no solid state voltage bleed-through. In the case of the relay 123, for example, in order to minimize degradation due to moisture, the relay 123 is typically hermetically sealed. Preferably, the control relay 123 is sealed under pressure using nitrogen or other substantially inert gas. Control relay 123 enjoys a very low voltage (3 to 4 volts) with a low current applied across its contacts. This results in virtually no arcing of contacts during relay operation, facilitating a longer relay life.

The components 122 also include a transformer 135. The transformer 135 typically transfers electrical energy from a power source to the electronic components 122 by magnetic coupling. In a typical embodiment, the transformer 135 reduces (or steps down) the voltage of the power source for application to the electronic components 122. For example, the transformer 135 may step-down a power source voltage of 120 volts to a desired control voltage of 24 volts (typically alternating current or "AC"). The transformer 135 may be, for example, part no. 52-110106 available through Austin Brown, Inc.

The transformer 135 typically includes two or more coupled windings and a core to concentrate magnetic flux. An alternating voltage applied to one winding creates a time-varying magnetic flux in the core, which induces a voltage in the other windings. Varying the relative number of turns between primary and secondary windings determines the ratio of the input and output voltages, thus transforming the voltage by stepping it up or, in a typical embodiment here, down between circuits.

It is preferred that the components 122 be sprayed with a material that further insulates the pump control 120 from the elements. In one aspect, OFF GUARD brand corrosion-inhibiting material (available from State Chemical Manufacturing Company of Cleveland, Ohio) is sprayed onto the pump control 120 to create a waterproof coating over the components 122.

Returning to FIG. 1, the sump pump control system 100 also includes a sump pump assembly 140. The sump pump assembly 140 includes a pump 142. The pump 142 is designed to pump water from a vault. One suitable pump is a Goulds Pump, Model SO511B from Seneca, N.Y. This pump has a ½ horsepower rating, and operates at 115 volts, 14.5 amps, and 1,725 RPM's. In one aspect, the pump 142 is positioned within a sump, that is, a hole within the vault below floor-level. A sump is indicated schematically in FIG. 1 by the box in broken lines.

The pump 142 typically rests on the ground. A sump discharge pipe 145 extends from the pump 142 in order to carry water from the sump and vault to the street (or other place of disposal). Primary discharge pipe 145 is typically a 2-inch galvanized metal pipe or 2-inch schedule-80 PVC pipe. The pump 142 is also connected to power wiring (not shown) delivered via the wiring bundle 131 to supply power to the pump 142 for operation.

In the assembly 140 of FIG. 1, three probes 144, 146, 148 are provided. Probe 144 is exposed to water at the bottom of the sump or vault floor. This is the "common" probe. As water rises, the water moves above the "common" probe 144 and contacts probe 146. This is the "on" probe. The water acts as a conductive medium, completing a circuit formed between the "common" probe and the "on" probe 146. This circuit completion delivers a control signal to one or more of the electronic components 122 (e.g., the relay 123 and the circuit board 127) which results in the activation (i.e., turning on) of the pump 142. As shown in FIG. 2, the probes 144, 146, 148 are supported by an electrode holder 171. The electrode holder may be, for example, an Ametek B&W 6012-C4I holder. The electrode holder 171 is attached to a rigid conduit 170. In one aspect, the conduit is a ½-inch Rigid EMT conduit. The conduit is attached to the support surface 132 using a ½-inch water-tight hub 173. The hub may be, for example, Thomas & Betts #54062005 hub.

The pump 142 will operate until the water level drops below the third probe. This is probe 148, which is the "off" probe. Similar to the above described operation via the "common" probe 144 and the "on" probe 146, when the water no longer completes the circuit formed between the "common" probe 144 and the "off" probe 148, it results in the pump 142 being deactivated (i.e., turned off).

The "common" probe 144 is typically positioned at or slightly above (e.g., less than one inch) the lowest surface of a vault such as the bottom of a sump or the vault floor itself. In turn, the "off" probe 148 is typically positioned high enough above the "common" probe 144 to allow for the detection of oil leakage from equipment in the vault by maintenance workers but low enough to prevent water from having prolonged contact with equipment in the vault. For example, in some instances, a transformer or other item of machinery may leak, causing oil to at least partially fill a vault. By positioning the "off" probe 148 at an appropriate height above the "common" probe 144 (e.g., approximately two to three inches), any oil present in the vault floating on top of the water will not be removed by the pump 142. By leaving the oil "unpumped," maintenance workers may be able to detect the presence of the oil in the vault and then have it vacuum pumped from the vault in an environmentally safe manner and repair the leaking equipment before further damage occurs to it.

There are instances in the field where a sump pump assembly 140 may cease to work. This could happen, for instance, in the event of a power failure in the substation. Alternatively, the sump pump 142 could mechanically break down or be jammed due to an obstruction. When this occurs, water may rise in the vault above the level of the bottom 115 of the cover 110. Of course, water could also rise above the level of the bottom 115 of the cover 110 when there is significant flooding such that the pump 142 is unable to keep up with rate of water influx into the vault. In either instance, the pressure of the ambient air within the cover 110 prevents the water from entering the cover 110 and contacting the control 120, thereby protecting the water-sensitive components from damage.

It has been observed that hydrostatic pressure can be sufficiently great to cause water to at least partially rise within the cover 110. In this respect, if a substation resides in a particularly deep vault, for example up to 25 feet, and if that vault fills up, and assuming that the sump pump control apparatus 100 is fixed at a height of 3 to 4 feet, then slightly more than 20 feet of hydrostatic pressure will act against the ambient air pressure within the cover 110. The hydrostatic gradient of fresh water is 0.433 psi/foot of depth. 20 feet of hydrostatic pressure is 8.66 psi of pressure. This level of pressure may cause several inches of air compression within a cover that is 12 inches high.

For this reason, it is desirable to provide a height "h" with respect to the electrical components 122. The height "h" is the vertical distance between the support surface 132 of the mounting fixture 130 and the lower edge of the electrical components 122. By positioning the electrical components 122 at or above the height "h", it is assured that any water infiltration of the cover 110 due to hydrostatic pressure will not contact the electrical components 122.

In one aspect, the sump pump control system 100 also includes an externally operable test switch. This allows a utility (or other) inspector to test the operability of the sump pump 142 without removing the cover 110 from over the pump control 120. The test switch may be, for example, a magnetic reed switch. Such a switch is shown at 128 in FIG. 2.

The magnetic switch 128 operates in conjunction with a magnet. A magnet assembly is seen at 150 in FIG. 1. The magnet assembly 150 includes a permanent magnet 152. The magnet 150 is preferably connected to the mounting fixture 130 by means of a stainless steel cable 154. In operation, the magnet 152 is passed over the PVC cap 114. The reed switch 128 inside of the cover 110 will close, causing the sump pump 142 to be momentarily activated.

The remotely actuatable switch 128 removes the need for a hole to be drilled through an upper portion of the cover 110 to mount a test push-button. Such an opening could create a point for moisture ingress to the covered control components 122.

Finally, the sump pump control system 100 may include a desiccant cartridge 160. The desiccant cartridge 160 serves to absorb moisture from the atmosphere. The desiccant cartridge 160 is preferably installed in close proximity to the electrical components 122. In FIG. 1 the desiccant cartridge 160 is shown in phantom affixed to the back side of the chassis 124 Optionally, the desiccant cartridge 160 may be attached to the mounting plate 134 in proximity to the electrical components 122, or even affixed to an inner surface of the diving bell cover 110. In this way, the desiccant cartridge 160 resides within the cover 110.

Figure 3:
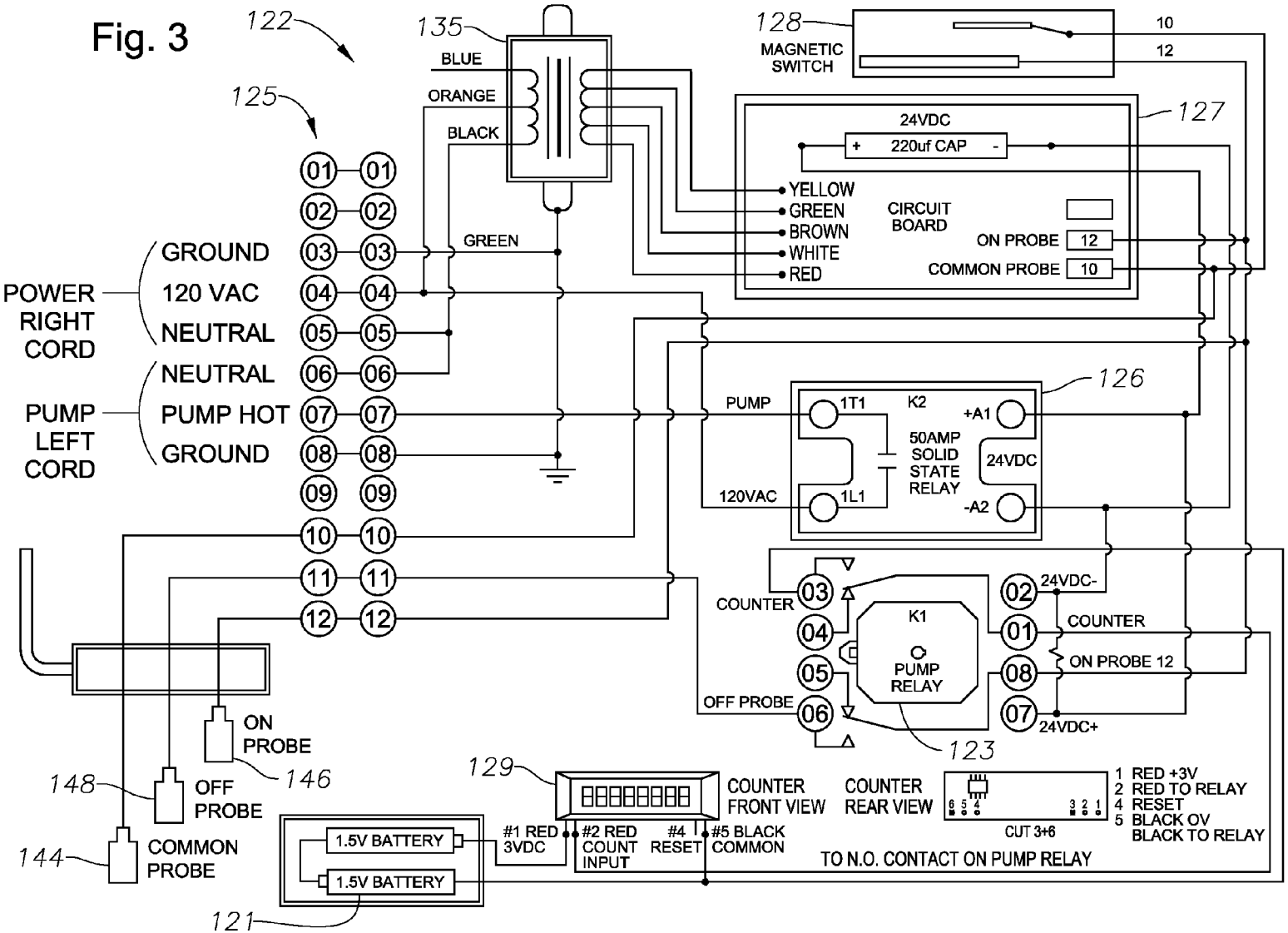
FIG. 3 is a circuit diagram showing interconnectivity of the electrical components of the sump pump control system, in one embodiment.

FIG. 3 provides a circuit diagram showing circuit connections of the electrical components 122 of FIG. 2. The circuit diagram also depicts exemplary connections of the probes 144, 146, 148 of the sump pump assembly 140 to the electrical components 122. It is noted that the arrangement of electrical components 122 and the circuitry in FIG. 2 are merely illustrative. Other ways of providing the functionality of the electrical interaction of parts to operate the sump pump 142 exist.

A method of removing water from a subterranean vault is also provided herein. The method is particularly suited to situations where the subterranean vault is a utility substation.

The method includes securing a mounting fixture to a structure within the vault above a ground level. The mounting fixture may be fixture 130 of FIG. 1. In this instance, the mounting fixture 130 is fabricated from a corrosion resistant material and comprises a support surface 132 and a mounting plate 134.

The method also includes providing a sump pump control. The sump pump control may be control 120 described above. For instance, the control may have an electrical control comprising solid state electrical components 122 connected to a chassis 124. The chassis 124 is fabricated from a corrosion-resistant material and is supported on the support surface 132 of the mounting fixture 130. The electrical components 122 control the operation of a sump pump.

The sump pump control 120 also includes a diving bell cover having an open bottom. The diving bell cover may be the cover 110, which is releasably secured to the support surface 132 of the mounting fixture 130.

The diving bell cover 110 is configured to encompass the electrical components 122. In addition, the electrical components 122 are mounted onto the chassis 124 at a position above the bottom of the diving bell cover 110 such that water will not contact the components 122 in the event that water surrounds the diving bell cover 110.

In the method, the sump pump control also includes a sump pump assembly. The sump pump assembly has a sump pump, a common probe, an "on" probe and an "off" probe. The sump pump may be pump 142 of FIG. 1, and the probes may be, for example, probes 144, 146, 148 described above.

The method also includes providing power to the sump pump assembly.

In one aspect, the sump pump control further comprises at least one latch, and preferably two latches, for releasably securing the diving bell cover 110 to the support surface 132 of the mounting fixture 130. The latch may be, for example, latch 116 of FIG. 1. Latch 116 is preferably fabricated from an elastomeric material. The method then further comprises securing the diving bell cover 110 to the support surface 132 of the mounting fixture 130.

Preferably, the sump pump control further comprises an externally operable test switch. The test switch may be magnetic switch 128 of FIGS. 2 and 3. In this instance, the sump pump control further comprises a permanent magnet that may be passed over the diving bell cover 110 in order to selectively turn on and off the sump pump 142. In one aspect, the sump pump 142 is turned on only momentarily. The method then further comprises passing the magnet 152 over the diving bell cover 110 to activate the sump pump 142.

The method may also include attaching a desiccant cartridge for absorbing moisture. The desiccant cartridge may be cartridge 160 of FIG. 1. Preferably, the cartridge 160 is attached to either the chassis 124 or an inside surface of the diving bell cover 110.

In one aspect, the subterranean vault contains both water and oil. In this instance, the method may further comprise pumping water from the subterranean vault, but then discontinuing pumping water before significant amounts of oil are encountered by the sump pump 142. In this way, oil is not pumped into the street or into an environmentally sensitive area. The oil may be vacuumed out later by a special truck.

The foregoing description and examples have been set forth merely to illustrate the inventions herein and are not intended to be limiting. Since modifications of the disclosed embodiments incorporating the spirit and substance of the inventions may occur to persons skilled in the art after reading this disclosure, the inventions should be construed broadly to include all variations falling within the scope of the appended claims and equivalents thereof.

What is claimed is:

1. A method of removing water from a subterranean vault, comprising:

securing a mounting fixture to a structure within the vault above a ground level, the mounting fixture comprising a support surface;

providing a sump pump control system having:

an electrical control comprising solid state electrical components connected to a chassis, wherein the chassis is supported on the support surface of the mounting fixture, a diving bell cover having an open bottom and being releasably secured to the support surface of the mounting fixture, the diving bell cover being configured to encompass the electrical components on the support surface, a sump pump assembly having a sump pump, a common probe, an "on" probe and an "off" probe, wherein:

the electrical control controls the operation of the sump pump, and the electrical components are mounted onto the chassis at a position above the bottom of the diving bell cover such that water will not contact the components in the event that water surrounds the diving bell cover; and providing power to the sump pump assembly.

2. The method of claim 1, wherein the sump pump control system further comprises at least one latch for releasably securing the diving bell cover to the support surface of the mounting fixture, the at least one latch being fabricated from an elastomeric material; and the method further comprises securing the diving bell cover to the support surface of the mounting fixture using the at least one latch.

3. The method of claim 1, wherein the sump pump control system further comprises an externally operable test switch.

4. The method of claim 3, wherein the externally operable test switch comprises a magnetic reed switch, and the sump pump control further comprises a permanent magnet that may be passed over the diving bell cover in order to momentarily turn on and off the sump pump; and the method further comprises passing the magnet over the diving bell cover to temporarily activate the sump pump.

5. The method of claim 1, wherein the electrical components are sprayed-coated with a clear electrical waterproof coating.

6. The method of claim 1, wherein the electrical components comprise:

a solid state circuit board; and a solid state power relay.

7. The method of claim 6, wherein the electrical components further comprise:

a hermetically sealed control relay with a base;

a transformer; and a terminal strip.

8. The method of claim 1, wherein the electrical components comprise:

a digital counter for counting each on/off cycle of the sump pump.

9. The method of claim 1, further comprising:

attaching a desiccant cartridge for absorbing moisture to the chassis, the mounting fixture or an inner surface of the diving bell cover.

10. The method of claim 1, wherein the subterranean vault is an electrical substation.

11. The method of claim 1, wherein the subterranean vault contains both water and oil, and the method further comprises:

pumping water from the subterranean vault; and discontinuing pumping water before significant amounts of oil are encountered by the sump pump.

12. The method of claim 1, wherein the mounting fixture and the chassis are both fabricated from a corrosion resistant material.

* * * * *